US010397704B2

(12) United States Patent
Tanabe

(10) Patent No.: US 10,397,704 B2
(45) Date of Patent: Aug. 27, 2019

(54) ACOUSTIC APPARATUS

(71) Applicant: ALPINE ELECTRONICS, INC., Shinagawa-ku, Tokyo (JP)

(72) Inventor: Kei Tanabe, Fukushima (JP)

(73) Assignee: ALPINE ELECTRONICS, INC., Tokyo (JP)

( * ) Notice: Subject to any disclaimer, the term of this patent is extended or adjusted under 35 U.S.C. 154(b) by 0 days.

(21) Appl. No.: 15/836,053

(22) Filed: Dec. 8, 2017

(65) Prior Publication Data

US 2018/0220227 A1 Aug. 2, 2018

(30) Foreign Application Priority Data

Jan. 31, 2017 (JP) ..... 2017-015339

(51) Int. Cl.
*H04R 7/06* (2006.01)
*H04R 7/02* (2006.01)
(Continued)

(52) U.S. Cl.
CPC ..... *H04R 7/06* (2013.01); *H04R 1/025* (2013.01); *H04R 1/2834* (2013.01); *H04R 7/02* (2013.01);
(Continued)

(58) Field of Classification Search
CPC ..... H04R 1/2834; H04R 1/025; H04R 7/02; H04R 9/025; H04R 31/003; H04R 2307/029
See application file for complete search history.

(56) References Cited

U.S. PATENT DOCUMENTS 4,562,899 A * 1/1986 Nakamura ..... H04R 7/122 181/169
4,709,392 A * 11/1987 Kato ..... H04R 7/26 181/157
(Continued)

FOREIGN PATENT DOCUMENTS

JP S57-017300 A 1/1982
JP 1988-59638 11/1988
(Continued)

OTHER PUBLICATIONS

Extended European Report for EP 17207456.9 dated Jun. 28, 2018.

*Primary Examiner* — Joshua Kaufman
(74) *Attorney, Agent, or Firm* — Brinks Gilson & Lione

(57) ABSTRACT

An acoustic apparatus may include a frame having an annular open portion that opens in an axial direction; a diaphragm supported by being attached to the annular open portion via a flexible edge member so as to be capable of vibrating in the axial direction; and a driving unit connected to the diaphragm at a center portion of the diaphragm, where the driving unit is configured to apply a driving force in the axial direction to the diaphragm. The diaphragm has a rotationally symmetric shape around an axis of the diaphragm when viewed in the axial direction. The diaphragm includes a sheet member having an orientation dispersion structure in which shape-anisotropic fillers are dispersed in a resin with long axes of the fillers oriented in one predetermined direction, and the diaphragm has mechanical characteristics having two-fold rotation symmetry around the axis.

2 Claims, 3 Drawing Sheets

(51) Int. Cl.

| | |
|---|---|
| ***H04R 31/00*** | (2006.01) |
| ***H04R 1/02*** | (2006.01) |
| ***H04R 1/28*** | (2006.01) |
| ***H04R 9/02*** | (2006.01) |

(52) U.S. Cl.
CPC ..... *H04R 9/025* (2013.01); *H04R 31/003* (2013.01); *H04R 2307/029* (2013.01)

(56) References Cited

U.S. PATENT DOCUMENTS

| | | | | |
|---|---|---|---|---|
| 2004/0265564 | A1* | 12/2004 | Tokura | B32B 5/18 428/316.6 |
| 2007/0183619 | A1* | 8/2007 | Kuribayashi | H04R 7/14 381/396 |
| 2008/0279415 | A1* | 11/2008 | Roemer | H04R 1/023 381/400 |
| 2012/0002833 | A1* | 1/2012 | Metzler | C08G 63/183 381/369 |
| 2018/0084345 | A1* | 3/2018 | Tanabe | H04R 7/16 |
| 2018/0220226 | A1* | 8/2018 | Tanabe | H04R 31/003 |

FOREIGN PATENT DOCUMENTS

| | | | | |
|---|---|---|---|---|
| JP | 2015-077740 | A | 4/2015 | |
| WO | 2014-104003 | A1 | 7/2014 | |
| WO | WO-2014104003 | A1 * | 7/2014 | H04R 31/003 |

* cited by examiner

ACOUSTIC APPARATUS

RELATED APPLICATIONS

The present application claims priority to Japanese Patent Appln. No. 2017-015339, filed Jan. 31, 2017, the entire disclosure of which is hereby incorporated by reference.

BACKGROUND

1. Field of the Disclosure

The present disclosure relates to an acoustic apparatus (speaker) having improved acoustic characteristics, in particular, improved acoustic characteristics in a high range.

2. Description of the Related Art

Acoustic apparatuses (speakers) should have the ability to reproduce original sounds as accurately as possible. To satisfy this objective, speaker components such as diaphragms have been improved in various ways.

For example, Japanese Examined Patent Application Publication No. 63-59638 discloses a diaphragm in which composite material sheets of a plurality of composite material sheets are laminated and integrally joined. Each of the composite material sheets is formed of reinforcing fibers having a high modulus of longitudinal elasticity and a matrix material that binds the fibers. The reinforcing fibers of each composite material sheet are oriented in a radial direction with respect to a vibration direction of the diaphragm. In the diaphragm, since the reinforcing fibers having the high modulus of longitudinal elasticity are dispersed in the matrix material such as a resin, the density decreases and the specific modulus of longitudinal elasticity (modulus of longitudinal elasticity/density) increases, and hence a diaphragm having frequency characteristics in a wide band may be obtained.

With use of a diaphragm such as the one disclosed in Japanese Examined Patent Application Publication No. 63-59638, good characteristics as those of a diaphragm using a light metal such as magnesium can be obtained. However, when such a material with a large specific modulus of longitudinal elasticity is used, in a case where the diaphragm has a highly symmetric shape, frequency characteristics having a sharp resonance peak (a band with a sound pressure being characteristically higher than the sound pressures in the other frequency bands) based on an axially symmetric mode in a high range may appear. A specific example of the shape of a diaphragm being highly symmetric may be a rotationally symmetric shape with a small rotation angle. A typical example is a continuously rotationally symmetric shape around the axis thereof. The shape can be expressed by a plurality of circles whose central axes are aligned with one another when viewed in the axial direction. The rotation angle around the axis becomes infinitely small, and the shape has continuous rotation symmetry.

An example of a method of suppressing the sharpening of the resonance peak in such a high range may be a method of decreasing the symmetry of the shape when viewed in the axial direction. A specific example may be an oblique-cone diaphragm or a diaphragm having a modified sectional shape.

However, the oblique-cone diaphragm and the diaphragm having the modified sectional shape have complicated shapes and have difficulty in manufacturing and assembly. A new resonance mode may be generated due to the eccentricity or modified sectional shape. When the frequency dependency of the sound pressure is measured, a spectrum having a characteristic peak or dip (a band in which the sound pressure is characteristically lower than the sound pressures in the other frequency bands) may be obtained.

SUMMARY

Regarding such circumstances in the related art, it is an object of the present disclosure to provide an acoustic apparatus in which sharpening of a resonance peak in a high range is properly suppressed and which has good acoustic characteristics.

In one aspect of the present disclosure, an acoustic apparatus (speaker) is provided that addresses the above-described problems. The acoustic apparatus may include a frame having an annular open portion that opens in an axial direction; a diaphragm supported by being attached to the annular open portion via a flexible edge member so as to be capable of vibrating in the axial direction; and a driving unit connected to the diaphragm at a center portion of the diaphragm, and configured to apply a driving force in the axial direction to the diaphragm. The diaphragm has a rotationally symmetric shape around an axis of the diaphragm when viewed in the axial direction. The diaphragm includes a sheet member having an orientation dispersion structure in which shape-anisotropic fillers are dispersed in a resin with long axes of the fillers oriented in one predetermined direction, and the diaphragm has mechanical characteristics having plane symmetry with respect to a plane, as a symmetry plane, including the orientation direction of the fillers and the axis.

As described above, regarding the oblique-cone diaphragm or the diaphragm having the modified sectional shape, the shape of the diaphragm is partly changed from a typical shape (for specific example, a shape having continuous rotation symmetry around the axis), and the symmetry of the shape when viewed in the axial direction is decreased. Hence, sharpening of a resonance peak with high frequencies is suppressed. By partly changing the shape of the diaphragm, the shape of the diaphragm may have a partial variation around the axis. When a driving unit applies an external force to the diaphragm having such a shape, deformation of the diaphragm caused by the external force may also vary in accordance with the variation in the shape of the diaphragm. As a result, when the diaphragm is vibrated by the driving unit, the symmetry of the vibration generated at the diaphragm may be decreased and the resonant frequency may be dispersed. The resonance frequency is properly dispersed, and hence appearance of a sharp resonance peak is suppressed.

The diaphragm of the speaker according to the aspect of the present invention decreases the symmetry of vibration of the diaphragm by giving anisotropy to the mechanical strength of a member forming the diaphragm, without decreasing the symmetry of the shape of the diaphragm. Specifically, since the sheet member forming the diaphragm has the orientation dispersion structure, and the mechanical characteristics in the orientation direction differ from the mechanical characteristics in the direction orthogonal to the orientation direction, the mechanical characteristics have two-fold rotation symmetry with a rotation angle of 180 degrees around the axis. Hence, the resonance frequency can be efficiently dispersed without decreasing the symmetry of the shape of the diaphragm. Owing to this, with forms of the speaker according to the aspect of the present disclosure, appearance of a sharp resonance peak is efficiently suppressed.

In forms of the above-described acoustic device (speaker), the diaphragm may include one seamless sheet member. The diaphragm may include a high-rigidity region and a low-rididity region. In the high rigidity region, an orientation direction of the fillers is parallel to a direction from a center portion to an outer circumferential portion of the diaphragm and flexural rigidity is high when it is attempted to bend an area between the center portion and the outer circumferential portion of the diaphragm. In the low-rigidity region, an orientation direction of the fillers is orthogonal to the direction from the center portion to the outer circumferential portion of the diaphragm and flexural rigidity is low when it is attempted to bend an area between the center portion and the outer circumferential portion of the diaphragm. The flexural rigidity may be continuously decreased from the high-rigidity region to the low-rigidity region.

In some implementations, the diaphragm may have a continuously rotationally symmetric shape around the axis of the diaphragm when viewed in the axial direction. As described above, the shape having the continuous rotation symmetry around the axis can be expressed by a plurality of circles whose central axes are aligned with one another when viewed in the axial direction. The diaphragm having such a shape typically has isotropic mechanical characteristics around the axis, and hence a resonance peak may be likely sharpened. However, as described above, in the diaphragm of the speaker in forms of the present disclosure, the sheet member forming the speaker has the orientation dispersion structure, and hence the mechanical characteristics have two-fold rotation symmetry with a rotation angle of 180 degrees around the axis. Accordingly, even when the shape of the diaphragm is a highly symmetric shape around the axis, a sharp resonance peak rarely appears when the diaphragm is vibrated in the axial direction. Moreover, the diaphragm with the highly symmetric shape is easily manufactured, and a peak or a dip due to the shape rarely appears in the frequency characteristics of the sound pressure, as compared with the oblique-cone diaphragm or the diaphragm with the modified sectional shape.

In some implementations, the diaphragm may be formed of one seamless sheet member. With the one seamless sheet member, the acoustic characteristics can be increased without a special treatment.

In some implementations, the diaphragm may be preferably a vacuum-formed article or a pressure-formed article formed of a sheet member in which the fillers are dispersed in a thermoplastic resin. The thermoplastic resin is easily handled, and when the thermoplastic resin is heated, vacuum forming or pressure forming can be carried out. The vacuum forming and pressure forming can decrease the cost of the mold as compared with injection molding etc., and the manufacturing cost may be suppressed.

In forms of the acoustic apparatus, by giving anisotropy to the mechanical characteristics using the member having the orientation dispersion structure as the sheet member forming the diaphragm, sharpening of a resonance peak in the high range can be properly suppressed, and good acoustic characteristics can be obtained. In addition, by increasing the symmetry of the shape of the diaphragm like a typical diaphragm, a defect caused by the low symmetry of the shape (appearance of a peak or a dip in the frequency characteristics of the sound pressure) rarely occurs. Accordingly, an acoustic apparatus including a diaphragm with a shape that can be easily manufactured, and having good acoustic characteristics can be obtained.

DETAILED DESCRIPTION OF THE DRAWINGS

Figure 1A:
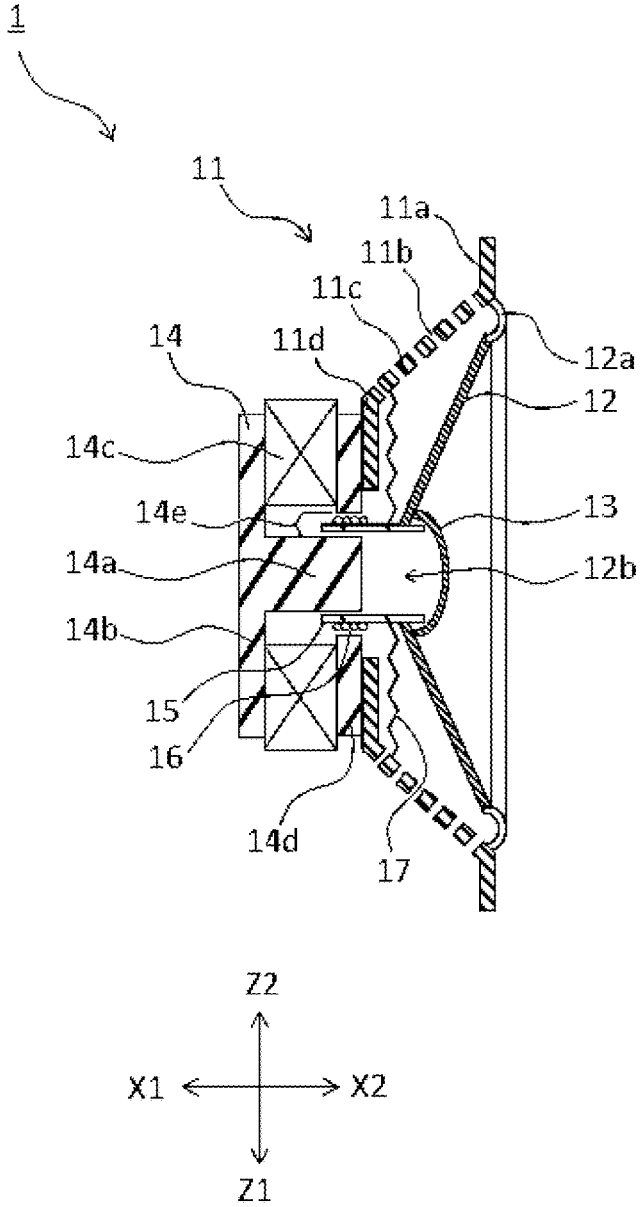
FIG. 1A is a conceptual sectional view illustrating a structure of a speaker according to one embodiment of the present disclosure.
Figure 1B:
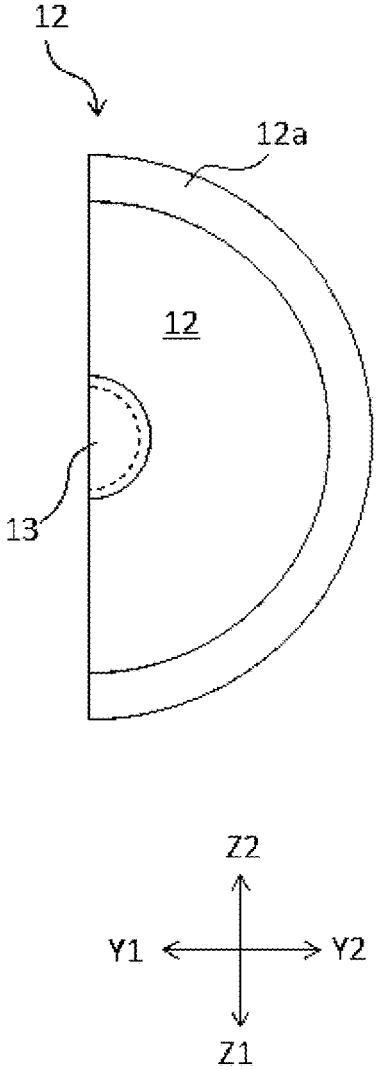
FIG. 1B is a partial plan view in the X1-X2 direction illustrating a structure of a diaphragm included in the speaker.
Figure 2A:
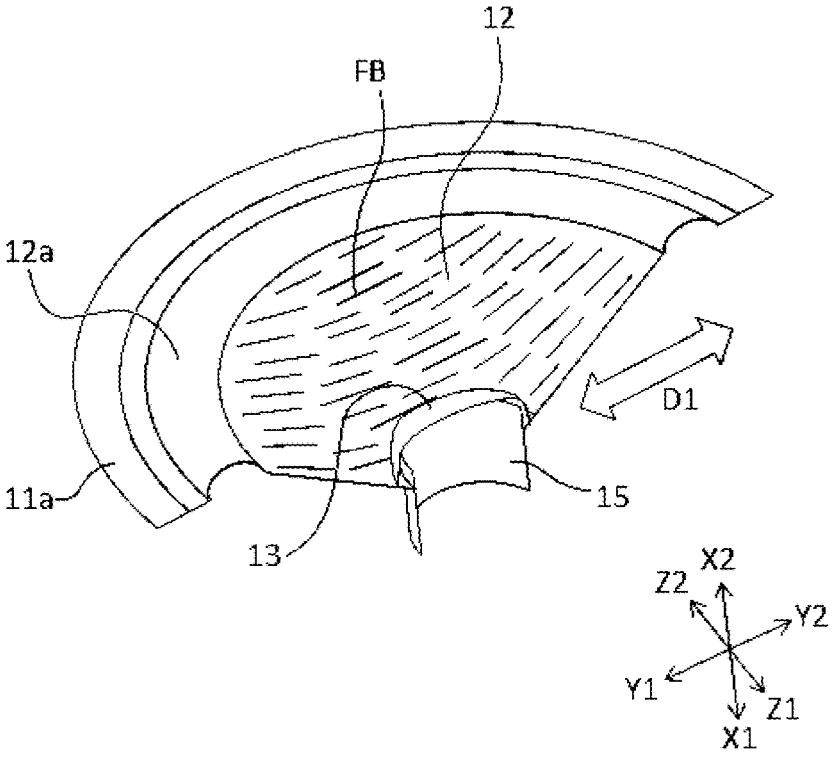
FIG. 2A is a sectional perspective view illustrating the structure of the diaphragm of the speaker according to the embodiment.
Figure 2B:
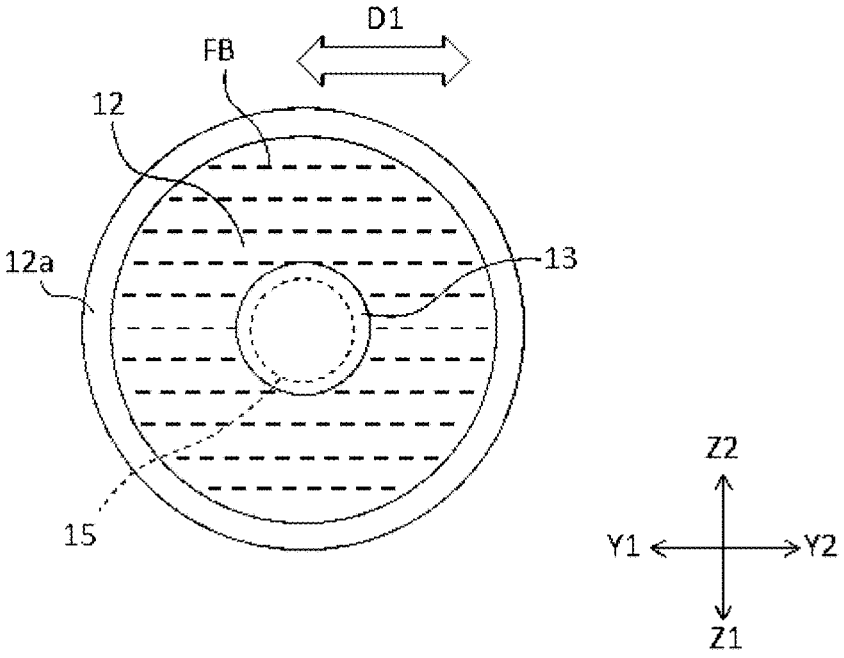
FIG. 2B is a plan view in the X1-X2 direction illustrating the structure of the diaphragm of the speaker according to one embodiment.

Embodiments and implementations of the present disclosure will be described below with reference to the drawings. FIG. 1A is a conceptual sectional view illustrating a structure of a speaker according to one embodiment of the present disclosure, and FIG. 1B is a partial plan view in the X1-X2 direction illustrating a structure of a diaphragm included in the speaker. In the plan view, a shape appearing on the Y1 side in the Y1-Y2 direction is the same as that appearing on the Y2 side in the Y1-Y2 direction; thus, the plan view illustrates only the Y2 side. FIG. 2A is a sectional perspective view illustrating the structure of the diaphragm of the speaker according to the embodiment, and FIG. 2B is a plan view in the X1-X2 direction illustrating the structure of the diaphragm of the speaker according to the embodiment. The sectional perspective view illustrates a section in which a sectional area of the diaphragm of the speaker is the maximum.

As illustrated in FIG. 1A, a speaker 1 may include a frame 11 having a substantially truncated cone shape and various members attached to the frame 11. The frame 11 includes, at an outer circumferential edge thereof, an annular open portion 11*a* having a circular-ring shape and a spoke-like support 11*c* extending from the annular open portion 11*a*. In the drawing, the support 11*c* is indicated by a discontinuous line having cut-out holes 11*b* for convenience of understanding.

A diaphragm 12 that generates a sound pressure in the speaker 1 includes a flexible edge member 12*a* at an outer circumferential edge of the diaphragm 12. The diaphragm 12 is supported by being attached to the annular open portion 11*a* via the flexible edge member 12*a* so as to be capable of vibrating in the axial direction (X1-X2 direction in FIG. 1A).

The diaphragm 12 has a substantially truncated cone shape and has a circular outer shape when viewed in the axial direction (X1-X2 direction). The diaphragm 12 includes the flexible edge member 12*a* at the outer circumferential edge thereof and is attached to the annular open portion 11*a* of the frame 11 via the flexible edge member 12*a*. In the speaker 1 in FIG. 1A, specifically, the flexible edge member 12*a* is bonded to the annular open portion 11*a* of the frame 11 using an adhesive agent. Supported by the frame 11 as described above, the diaphragm 12 can vibrate in the X1-X2 direction. The diaphragm 12 includes an opening (diaphragm opening) 12*b* at a center portion when viewed in the axial direction (X1-X2 direction). The diaphragm 12 is connected to a bobbin 15 at an inner circumferential surface of the diaphragm opening 12*b*. The bobbin 15 is a part of a driving unit (described later).

A dust cap 13 having a hemispherical-cap shape is disposed on the X2 side of the diaphragm 12 in the X1-X2 direction to cover the diaphragm opening 12*b*. The dust cap 13 is a member that suppresses unstable operation of the bobbin 15 because a foreign substance enters the diaphragm opening 12*b* toward the X1 side in the X1-X2 direction.

The support 11*c* of the frame 11 has a truncated cone shape and has a top portion (magnetic circuit mount portion 11*d*) on which a magnetic circuit 14 is mounted. The magnetic circuit 14 includes a columnar center pole 14*a*. The center pole 14*a* has a central axis directed in a vibration direction (axial direction (X1-X2 direction)) of the diaphragm. Around the rear (the X1 side in the X1-X2 direction) of the center pole 14*a*, a bottom plate 14*b* is disposed so as to be integral with the center pole 14*a*. On the front side (the X2 side in the X1-X2 direction) of the bottom plate 14*b*, an annular magnet 14*c* is mounted. On the front side (the X2 side in the X1-X2 direction) of the magnet 14*c*, an annular top plate 14*d* is mounted. The provision of the magnet 14*c* forms an annular magnetic gap 14*e* between the center pole 14*a* and the top plate 14*d*. The bottom plate 14*b* and the top plate 14*d* form a yoke.

On the rear side (the X1 side in the X1-X2 direction) of the diaphragm 12, the bobbin 15 having a cylindrical shape is secured. As illustrated in FIG. 1A, the bobbin 15 is inserted into the magnetic gap 14*e* of the magnetic circuit 14 positioned on the rear side (the X1 side in the X1-X2 direction) of the diaphragm 12. The bobbin 15 includes a portion inserted into the magnetic gap 14*e*, the portion having a side surface around which a voice coil 16 is wound. The bobbin 15 reciprocates in the axial direction (X1-X2 direction) in accordance with a current flowing through the voice coil 16 positioned inside the magnetic gap 14*e*, which causes the diaphragm 12 to vibrate and generate a sound pressure.

A damper 17 is disposed between the diaphragm 12 and the magnetic circuit 14 in the axial direction (X1-X2 direction). The damper 17 is supported by the support 11*c* of the frame 11 at an outer circumference side of the damper 17, and supports the bobbin 15 at an inner circumference side of the damper 17. The damper 17, in addition to the diaphragm 12, also reciprocates in the axial direction (X1-X2 direction) along with the reciprocation of the bobbin 15. The damper 17 is formed of an elastic member. In a state in which no current flows through the voice coil 16, the damper 17 has a function of returning the bobbin 15 to a neutral position by using an elastic recovery force.

The speaker 1 having such a structure can generate, as described above, a sound pressure in the axial direction X1 (X1-X2 direction) by causing a current to flow through the voice coil 16 to thereby cause the diaphragm 12 to vibrate. The proportionality coefficient between the magnitude of the current flowing through the voice coil 16 and the magnitude of a sound pressure to be generated is ideally the same at any frequency. However, in reality, for example, the resonant frequency of the speaker 1 influences the frequency dependence of the sound pressure to have a peak (a band in which the sound pressure is high) and a dip (a band in which the sound pressure is low) in a specific range. In particular, when the diaphragm 12 has a shape continuously rotationally symmetric around the axis (the line in the X1-X2 direction) like the speaker 1 illustrated in FIG. 1, that is, when the diaphragm has a shape which may be expressed with a plurality of coaxial circles, a resonance peak in a high range is likely sharpened when viewed in the X1-X2 direction.

Figure 3:
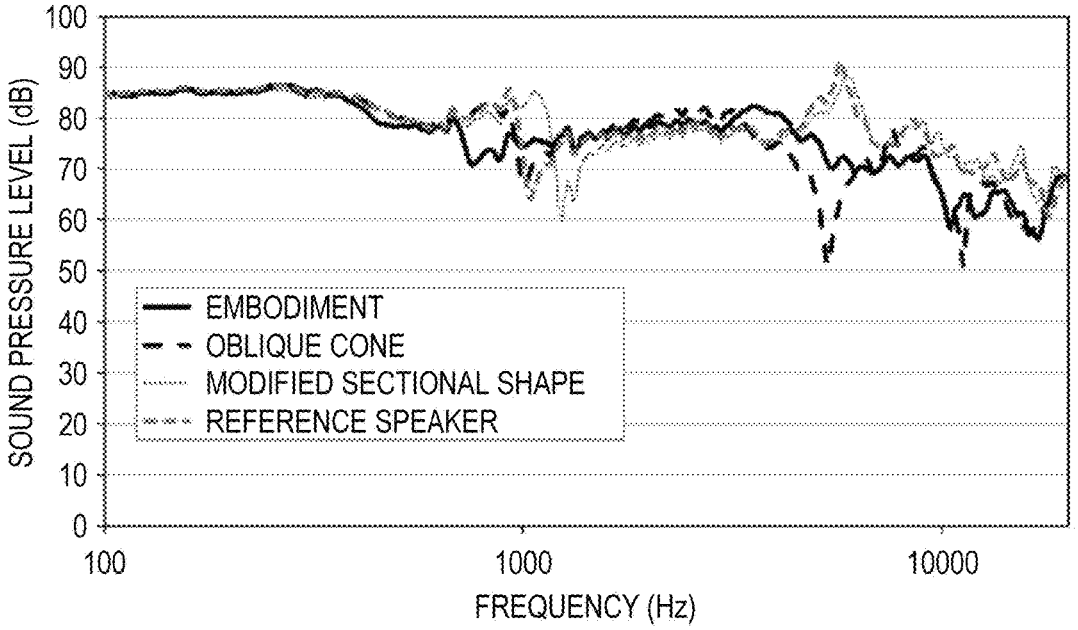
FIG. 3 is a graph showing frequency characteristics of a speaker according to a modification of one embodiment of the present disclosure, together with frequency characteristics of speakers having other structures.

FIG. 3 is a graph showing frequency characteristics of a speaker according to a modification of one embodiment of the present disclosure, together with frequency characteristics of speakers having other structures. The graph indicated by a gray broken line in FIG. 3 is a graph showing frequency characteristics of a speaker (hereinafter, referred to as reference speaker) including a diaphragm having mechanical characteristics isotropic around the axis (the line in the X1-X2 direction), that is, a speaker with the shape and mechanical characteristics having continuous rotation symmetry around the axis (the line in the X1-X2 direction). As illustrated in FIG. 3, there is found a peak at which the sound pressure is locally high with frequencies around 5 kHz. This peak is based on the resonance of the diaphragm.

In order to decrease the intensity of such a resonance peak, the diaphragm 12 of the speaker 1 is formed of a sheet member that has an orientation dispersion structure in which shape-anisotropic fillers FB are dispersed in a resin with the long axes thereof oriented in one predetermined direction (specifically, orientation direction D1 along the Y1-Y2 direction) as illustrated in FIGS. 2A and 2B.

Using the sheet member having the orientation dispersion structure to form the diaphragm 12, as described above, improves the mechanical characteristics of the diaphragm when compared with a case in which the fillers FB are not contained. As a result, the mechanical characteristics of the diaphragm 12 can be improved.

Examples of the shape-anisotropic fillers FB include carbon-based materials, such as carbon fiber and carbon nanotubes, and oxide-based materials, such as glass fiber. The length of each of the fillers FB may be any length. Non-limiting examples of the length are a length between 0.01 to 10 mm inclusive, or may be preferably a length between 0.1 mm to several millimeters inclusive from a viewpoint of ease of handling. The ratio of the length of the major axis of each filler FB to the length of the minor axis of the filler FB, what is called the aspect ratio, may be any ratio. The aspect ratio of each filler FB may be preferably 5 or higher. The type of the resin contained in the sheet member is not limited. Non-limiting examples of the resin are polyolefin, such as polyethylene and polypropylene; polyester, such as polyethylene terephthalate; polyamide, such as nylon 6,6; polyvinyl chloride; and polyimide.

The method of manufacturing the sheet member may be any method, as long as the sheet member can have an appropriate orientation dispersion structure. Specific examples of the method of manufacturing the sheet member are extrusion forming, expansion, and blow forming. The sheet member may preferably contain a filler having high orientation dispersion properties, so as to have high in-plane uniformity. In such a case, the sheet member is preferably an extrusion-formed article. With such a sheet member being the extrusion-formed article, the uniformity of the material of the sheet member as a constituent material of the diaphragm 12 is increased, which may make it easy to realize the speaker 1 having excellent quality uniformity.

The diaphragm 12 is formed of such a sheet member. The manufacturing method of the diaphragm 12 is not particularly limited. The manufacturing method of the diaphragm is typically vacuum forming or pressure forming of forming a sheet member with use of a mold having an exhaust hole. By heating the sheet member during vacuum forming etc., formability may be increased.

Since the sheet member has the orientation dispersion structure as described above, the sheet member has anisotropic mechanical characteristics. Specifically, the mechanical characteristics in the orientation direction D1 differ from the mechanical characteristics in a direction orthogonal to the orientation direction D1. The modulus of longitudinal elasticity and specific frequency are typically relatively high in the orientation direction D1, and the tensile elasticity is relatively high in the direction orthogonal to the orientation direction D1.

As described above, since the sheet member has the orientation dispersion structure in the diaphragm 12 formed by including the sheet member, the mechanical characteristics, in particular, the modulus of longitudinal elasticity of the diaphragm 12 is increased as compared with a diaphragm formed of a sheet member in which fillers are not dispersed. Also, since the sheet member has the anisotropic mechanical characteristics, the mechanical characteristics of the diaphragm 12 in the orientation direction D1 of the sheet member differ from the mechanical characteristics of the diaphragm 12 in the direction orthogonal to the orientation direction D1. As a result, the mechanical characteristics of the diaphragm 12 have two-fold rotation symmetry with a rotation angle of 180 degrees around the axis (the line in the X1-X2 direction). Hence, the shape of the diaphragm 12 of the speaker 1 has continuous rotation symmetry around the axis (the line in the X1-X2 direction), and the mechanical characteristics of the diaphragm 12 have two-fold rotation symmetry. In terms of rotation symmetry, two-fold rotation symmetry has the lowest symmetry. Due to this, when the diaphragm 12 vibrates, a resonance peak in a high range is less likely sharpened in the frequency characteristics of the sound pressure.

In other words, the diaphragm 12 includes a high-rigidity region and a low-rigidity region. In the high-rigidity region, the orientation direction of the fillers is parallel to a direction from a center portion to an outer circumferential portion of the diaphragm 12 and flexural rigidity there is high when it is attempted to bend an area between the center portion and the outer circumferential portion of the diaphragm 12. In the low-rigidity region, the orientation direction of the fillers is orthogonal to the direction from the center portion to the outer circumferential portion of the diaphragm 12 and flexural rigidity there is low when it is attempted to bend an area between the center portion and the outer circumferential portion of the diaphragm 12. Flexural rigidity is continuously decreased from the high-rigidity region to the low-rigidity region. This causes the resonance peak in the high range to be continuously dispersed.

FIG. 3 shows the frequency characteristics of the speaker 1 according to an aspect of the present disclosure using a solid line. As shown in FIG. 3, there is no sharp peak in a band around 5 kHz whereas a peak is clearly found in the graph indicated by the gray broken line (the frequency characteristics of the reference speaker).

FIG. 3 shows the frequency characteristics of a speaker including an oblique-cone diaphragm (black broken line), and the frequency characteristics of a speaker including a diaphragm with a modified sectional shape (black fine dotted line), although the basic shape of each of the speakers is common to the shape of the speaker 1. The outer shape of the diaphragm with the modified sectional shape has, for example, an S-shaped ridge line, the shape which has eight-fold rotation symmetry around the axis (the line in X1-X2 direction).

In the case of the speaker including the oblique-cone diaphragm, a dip appears with frequencies around 5 kHz. This may be caused by rolling of the diaphragm having an eccentric shape. In the case of the speaker including the diaphragm with the modified sectional shape, a strong peak is found with frequencies around 5 kHz although the intensity thereof is slightly lower than that of the reference speaker. This may be because the diaphragm still has a highly symmetric shape around the axis (the line in the X1-X2 direction).

Illustrative embodiments and implementations of the present disclosure have been described above. However, the present disclosure is not limited thereto. For example, a configuration realized through appropriate addition, omission, and design change of components by a person skilled in the art with respect to the aforementioned embodiments or application examples thereof and a configuration realized through an appropriate combination of the features in the embodiment are included in the scope of the present disclosure provided that such speakers realize the concept of the present invention.

For example, the diaphragm 12 may be a formed article having a laminated structure including the sheet member having the above-described orientation dispersion structure and an exterior sheet. The provision of the exterior sheet improves the design of the diaphragm. However, the weight of the diaphragm is increased, and hence the acoustic characteristics may be decreased (for example, a sound pressure in a high range may be decreased).

It is therefore intended that the foregoing detailed description be regarded as illustrative rather than limiting, and that it be understood that it is the following claims, including all equivalents, that are intended to define the spirit and scope of this disclosure.

What is claimed is:

1. An acoustic apparatus comprising:

a frame having an annular open portion that opens in an axial direction;

a diaphragm supported by being attached to the annular open portion via a flexible edge member so as to be capable of vibrating in the axial direction; and a driving unit connected to the diaphragm at a center portion of the diaphragm, where the driving unit is configured to apply a driving force in the axial direction to the diaphragm, wherein the diaphragm has a continuously rotationally symmetric shape around an axis of the diaphragm when viewed in the axial direction, wherein the diaphragm is formed of one seamless sheet member having an orientation dispersion structure in which shape-anisotropic fillers are dispersed in a resin with long axes of the fillers oriented in one predetermined direction; and wherein the diaphragm includes:

a high-rigidity portion of the diaphragm in which the orientation direction of the fillers is parallel to a direction from a center portion to an outer circumferential portion of the diaphragm and flexural rigidity in the high-rigidity portion is greater than portions of the diaphragm where the orientation of the fillers is orthogonal to the direction from the center portion to the outer circumferential portion of the diaphragm when it is attempted to bend an area between the center portion and the outer circumferential portion of the diaphragm, a low-rigidity portion of the diaphragm in which the orientation direction of the fillers is orthogonal to the direction from the center portion to the outer circumferential portion of the diaphragm and flexural rigidity in the low-rigidity portion is less than portions of the diaphragm where the orientation of the fillers is parallel to the direction from a center portion to an outer circumferential portion of the diaphragm when it is attempted to bend an area between the center portion and the outer circumferential portion of the diaphragm, where flexural rigidity is continuously decreased from the high-rigidity portion to the low-rigidity portion, and the diaphragm has mechanical characteristics having two-fold rotation symmetry around the axis.

2. The acoustic apparatus according to claim 1, wherein the diaphragm is a vacuum-formed article or a pressure-formed article formed of a sheet member in which the fillers are dispersed in a thermoplastic resin.

* * * * *